United States Patent [19]

Gohon

[11] Patent Number: 4,932,349

[45] Date of Patent: Jun. 12, 1990

[54] APPARATUS FOR UNDERWATER PAINTING

[75] Inventor: Eric Gohon, Issy les Moulineaux, France

[73] Assignee: Ruxington Corporation N.V., Curacao, Netherlands Antilles

[21] Appl. No.: 255,247

[22] Filed: Oct. 11, 1988

[30] Foreign Application Priority Data

Oct. 9, 1987 [FR] France ..... 8714264

[51] Int. Cl.[5] ..... B63B 59/00

[52] U.S. Cl. ..... 114/222; 401/286

[58] Field of Search ..... 114/222, 221 R; 15/1.7, 15/49 R, 52, 159 R, 179; 427/429; 401/268, 285–290

[56] References Cited

U.S. PATENT DOCUMENTS

| | | | |
|---|---|---|---|
| 2,275,350 | 3/1942 | Cords | 401/286 |
| 4,314,521 | 2/1982 | Lundberg | 114/222 |
| 4,698,005 | 10/1987 | Kikuchi et al. | 401/286 |

*Primary Examiner*—Joseph F. Peters, Jr.
*Assistant Examiner*—Edwin L. Swinehart
*Attorney, Agent, or Firm*—William A. Drucker

[57] ABSTRACT

The invention provides a method of underwater painting and a device for implementing same, the paint application brush comprising a rigid axial duct driven in rotation for feeding the paint, from which radiate a plurality of flexible ducts and in which the support for the bristles of the brush is secured to said rotary rigid duct by a connection comprising a flexible element allowing a certain free axial movement of said support.

6 Claims, 2 Drawing Sheets

APPARATUS FOR UNDERWATER PAINTING

BACKGROUND OF THE INVENTION

1. Field of the Invention

Although paints exist which dry rapidly underwater, underwater painting has not, up to now, been practiced over large surfaces, using rapid implementation methods.

Different apparatus for applying paint to an immersed surface, using moving brushes, have been described in particular in patents FR-A-1 567 045, FR-A-2 342 875, FR-A-2 389 420, FR-A-2 462 201, FR-A-2 144 115, FR-A-2 195 925, FR-A-2 369 952, U.S. Pat. Nos. 2,806,236, 4,084,535, 4,058,082 and 3,303,812.

All these apparatus are either complex in construction or delicate to adjust or insufficiently reliable in operation.

The invention relates more particularly to apparatus which comprise at least one moving application brush in which the active end of the bristles comes into contact with the surface to be painted substantially perpendicularly thereto and comprises a permanent paint supply device.

The apparatus is moved in translation over this surface to be painted, the most often by a diver. The two essential problems to be solved in the construction of this kind of apparatus are the regular paint supply so as to obtain an adherent coat and to avoid losses of paint in the water and the formation of solid deposits on the bristles, and equalization of the coat by smoothing Equalization may be obtained either by scrapers made from a resilient material (FR-A-1 567 045), or by means of rotary smoothing brushes (FR-A-2 462 201). The application brush is either driven in movement about its axis (FR-A-2 342 875), or subjected to a reciprocating translational movement, which may be parallel to the surface to be painted (FR-A-1 567 045) or perpendicular thereto (FR-A-2 389 420), this perpendicular translation being possibly accompanied by a rotary movement (FR-A-2 389 420).

The supply is provided either at the periphery of the application brush (FR-A-1 567 045), or at the center thereof (FR-A-2 342 875).

2. Description of the Prior Art

According to patent FR-A-2 565 508, the bristles are supplied at the center of tufts of bristles which form the application brush at points situated at the non active ends of said tufts. The paint is distributed radially from a central channel into the tuft of bristles, forming a hole in the support of the tuft and arrives along the bristles as far as the application end. This solution functions correctly, provided that the injection pressure of the paint is adjusted with great accuracy, on the one hand, and that the pulsating movement perpendicular to the surface to be painted to which the bristles are subjected is adjusted to correctly drive out the water between the surface and the application end of the bristles (stencil effect), on the other; it is important that there is no breakage of the paint film during the application, which requires very delicate adjustments. Such adjustments depend more particularly on the rotational speeds of the brushes of the apparatus moving in translation over the surface and the thickness of the desired coat.

The U.S. Pat. No. 3,860,987 describes an underwater painting device comprising a brush rotating about an axis substantially perpendicular to the surface to be painted, characterized in that the brush has at least two separate zones in which the bristles have different hardnesses, the zone of the more flexible flexible bristles which serves for smoothing, surrounding the zone of harder bristles, which serves for depositing the paint. The free ends of the supple bristles extend beyond the free ends of the harder bristles and the paint is supplied by means of flexible duct portions which pass between the bristles of the harder bristle zone and whose ends emerge in the vicinity of the free end of the bristles. In this arrangement, only the central zone of the brush participates in the paint supply and, in addition, since the bristles of the outer zone are longer than those of the central zone, the flexible tubes do not emerge in the immediate vicinity of the surface to be painted.

SUMMARY OF THE INVENTION

The invention proposes using a brush with a substantially flat active surface formed of substantially identical bristles (of the same hardness and the same length) which form a substantially continuous and homogeneous cover, in which the paint is supplied by means of a plurality of flexible duct portions which pass between the bristles and whose ends emerge at points distributed so as to feed the whole of said active surface.

According to an important feature of the invention, the linear speed of circular translation of the bristles is about 1 m/sec.

According to an important feature of the invention, the linear speed of circular translation of the bristles is about 1 m/sec.

According to another feature, the flexible ducts are distributed so that the travel distance of the bristles between the ends of the successive flexible ducts is about 10 cm.

In a preferred embodiment, a paint application brush for implementing said method comprises a rigid axial paint feed duct, driven in rotation, from which radiate a plurality of flexible ducts, an end portion of which forms said flexible duct portions and the support for the bristles of the brush is made fast with said rigid rotary duct by a connection comprising a flexible element allowing a certain free axial movement of said support.

The speed of rotation of the application brush is adjusted so that it may provide the smoothing function (advantageously between 50 and 70 rpm for an outer diameter of the brush of 40 cm).

BRIEF DESCRIPTION OF THE DRAWINGS

Other features and advantages of the invention will be clear form the following description, with reference to the accompanying drawings in which.

DESCRIPTION OF THE PREFERRED EMBODIMENT

Figure 1:
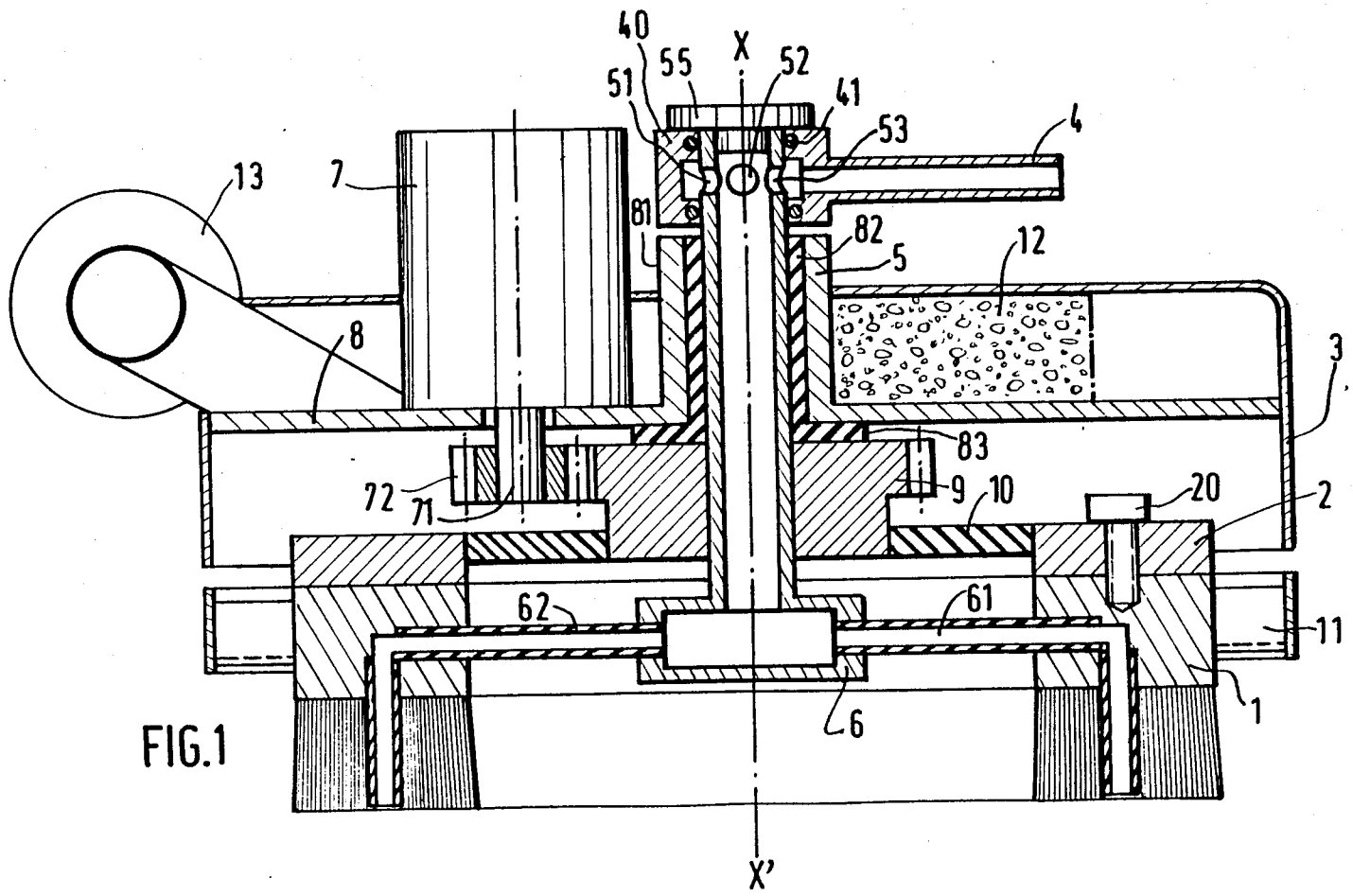
FIG. 1 shows a preferred embodiment of the paint application device of the invention, in section through I—I of FIG. 2.
Figure 2:
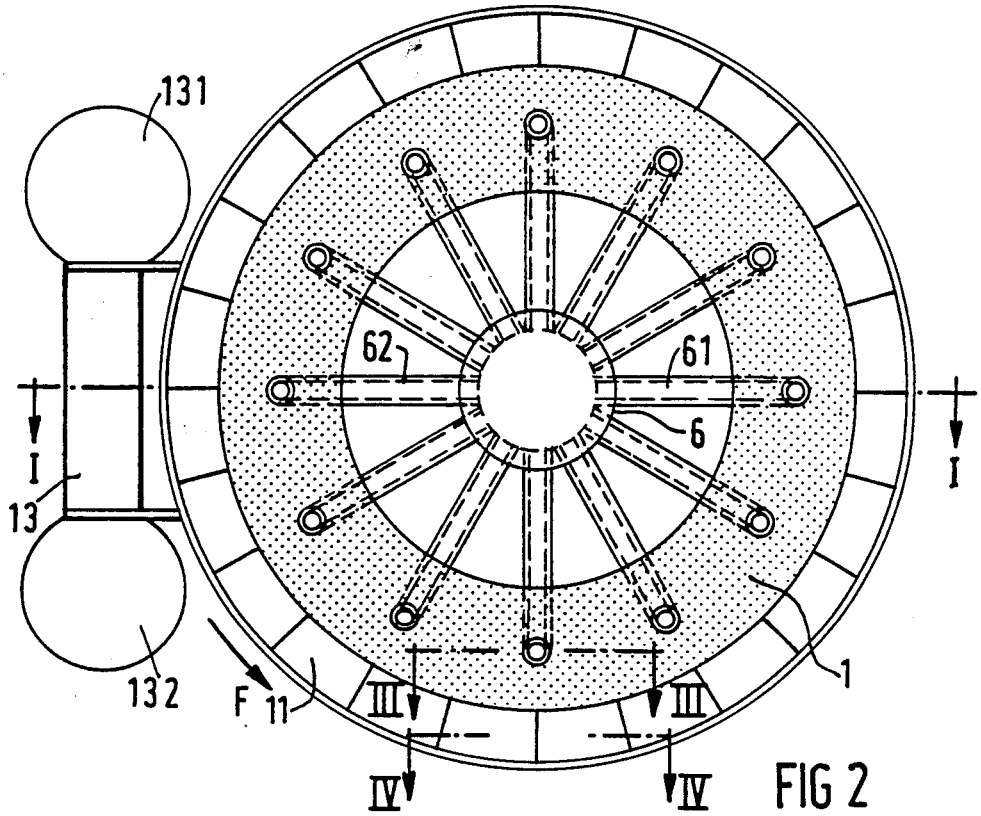
FIG. 2 is a bottom view of the device.

In FIGS. 1 and 2 a paint application device has been shown comprising a brush 1 having, by way of example, the shape of a circular ring with an outer diameter of 40 cm, supported by an annular piece 2 fixed by means of screws such as 20 to the casing 3 of the painting machine. The latter has, ion a way known per se, a motor driven surface unit comprising a hydraulic motor drive pump for circulating the paint.

The paint arrives through a flexible duct fixed to a connection 4 which gives into a chamber of a fixed paint manifold 40 mounted about a rotary distributor tube 5, a rotary seal 41 providing sealing. The paint penetrates into tube 5, passing from its upper end closed by a plug 55, through orifices such as 51-52-53 and arrives at the base of tube 5 in a chamber formed by a distribution box 6, from which radiate flexible ducts such as 61, 62 which, by way of example, are twelve in number in FIG. 2.

These ducts are bent at right angles at their end distant from the axis of symmetry XX' of the device and their portions perpendicular to the lower plane of the bristles end in the immediate vicinity of said plane (active surface of the brush), as will be explained further on.

A motor 7, for example hydraulic, is mounted on a structural part 8 inside the casing, and its shaft 71 drives a pinion 72 which itself drives a toothed wheel 9 fastened directly to tube 5 and the annular support 2 of the brush through a flexible annular membrane 10, e.g. made from rubberized cloth or from a synthetic material.

The tube is thus rotated about its axis, advantageously at a speed of a revolution per second, inside the fixed manifold 40 and a fixed sleeve 81 which extends part 8. Sleeve 8 houses a friction bearing made from an appropriate plastic material, which forms a stop at 83 so as to prevent, in cooperation with plug 55, the axial movement of tube 5.

Since ducts 61, 62 and the connecting membrane 10 are flexible, the brush and its support may undergo axial low amplitude movements.

Figure 4:
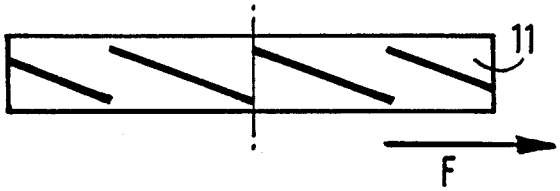
FIG. 4 is a partial section through IV—IV of FIG. 2.

A circular propeller 11 completely surrounds the support of the brush to which it is fixed. As shown in FIG. 4, its fins are oriented with respect to the rotational direction indicated by arrow F so as to create a thrust component which tends to apply the brush against the surface to be painted.

The buoyancy of the device is essential provided by a block 12 of an appriate* light material housed inside the casing.

A handle 13, with floats 131, 132 at its ends, is provided for carrying the apparatus. Handling of this latter in the water is ensured, ion a way known per se, by means not shown.

Figure 3:
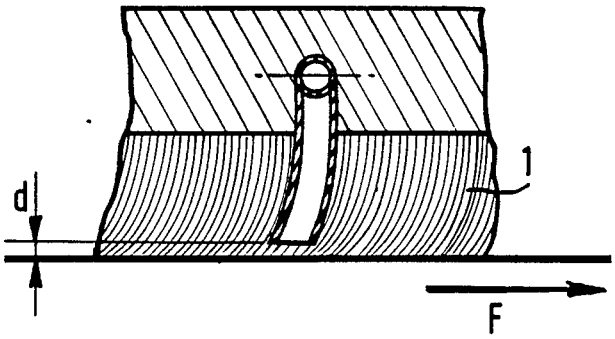
FIG. 3 is a partial section through III—III of FIG. 2.

In operation, the paint moves down into the flexible duct portions and its free travel between the end of the ducts and the surface to be painted (distance d, FIG. 3) is only about 0.2 to 1 mm for example.

This distance d is chosen as small as possible, a minimum value being however in practice provided so as to prevent the ducts from rubbing against the surface to be painted, because of the slant of the bristles due to rotation of the brush. The flexibility of the ducts is advantageously close to that of the bristles, so that they undergo the same slant and so that said risk is reduced, even if the distance between the end of the ducts and the lower plane of the brush is very small.

Because of the rotation of the brush at the speed indicated, the paint is distributed uniformly over the surface of the surface to be painted. The smoothing function is thus provided by the application brush itself, without it being necessary to provide additional smoothing brushes or zones. Experience shows that this advantageous result is only obtained if the linear speed of circular translation of the bristles is sufficient. It is also advantageous for the travel distance of the bristles between the ends of the successive flexible ducts to be sufficiently small. In the embodiment described, this distance is about 10 cm or so and, with the linear speed about 120 cm/sec (this speed may vary between 0.70 m and 1.30 m/sec, for example), the travel time is about 1/10 sec. It will be noted that each of the paint blobs which is formed at the positions where the paint arrives on the surface to be painted is thus covered in a very short time by the following blob, whereas the distance between the blobs is relatively small. These conditions are favorable to obtaining a good application of the paint and good smoothing.

Because of the flexible connection between the brush and the distributor tube, the active surface of the brush permanently adheres to the surface to be painted, even if the latter has irregularities and if the diver involuntarily causes slight movement of the machine perpendicular to said surface.

The result is that, over the whole active surface of the brush, no breakage of the paint film and, accordingly, no contact between the paint and the water is possible during application. The paint rises by capillarity from this surface to the inside of the brush, but no paint deposit is observed at the periphery thereof. The curvature of the surfaces to be painted is, in the majority of cases, sufficiently small for the active surface of the brush to mate perfectly therewith. However, it may be advantageous to provide brushes of a smaller diameter for painting surfaces with large curvature.

To obtain good smoothing, it is advantageous for the brush to have a practically continuous active surface and not tufts spaced relatively from each other. It goes without saying that instead of using a continuous ring of bristles, the brush could be formed of small brushes having active surfaces which are juxtaposable without discontinuity (trapezoidal shape for example).

It goes without saying that different modifications may be made to the device described and shown without departing from the scope and spirit of the invention.

What is claimed is:

1. An apparatus for underwater painting, comprising a brush having bristles and rotating about an axis substantially perpendicular to the surface to be painted, flexible duct portions supplying paint to the brush, said flexible duct portions passing between the bristles and emerging in the vicinity of their free ends, wherein the free ends of the bristles are distributed over a substantially flat active surface formed of substantially identical bristles which form a substantially continuous and homogeneous cover, with the ends of the flexible duct portions emerging at points substantially uniformly distributed on a substantially plane surface facing the active surface and parallel thereto.

2. An apparatus as claimed in claim 1, wherein the bristles are subjected to a circular translation at a speed of about 1m per second.

3. An apparatus as claimed in claim 1, wherein said free ends are distributed substantially uniformly over a circular ring centered on said axis, with a distance of about 10 cm between the ends of the successive flexible duct portions, as measured along said ring.

4. An apparatus as claimed in claim 1, wherein the rotational speed of the brush is between 50 and 70 rpm, the brush having an outer diameter of 40 cm.

5. The apparatus as claimed in claim 1, comprising a rigid axial duct driven in rotation for feeding the paint, a plurality of flexible ducts radiating from said axial duct, end portion of said flexible ducts forming said flexible duct portions, support means for the bristles of the brush, said support means being fastened to said axial duct by connection means comprising a flexible element allowing a certain free axial movement of said support means.

6. An apparatus as claimed in claim 5, wherein the distance between the ends of the flexible duct portions and the active surface of the brush is about 0.2 mm.

* * * * *